US005840090A

United States Patent [19]

Ho et al.

[11] Patent Number: 5,840,090

[45] Date of Patent: Nov. 24, 1998

[54] HIGH PERFORMANCE ABRASIVE ARTICLES CONTAINING ABRASIVE GRAINS AND NONABRASIVE COMPOSITE GRAINS

[75] Inventors: Kwok-Lun Ho, Woodbury; Walter L. Harmer, Arden Hills, both of Minn.

[73] Assignee: Minnesota Mining and Manufacturing, St. Paul, Minn.

[21] Appl. No.: 929,556

[22] Filed: Sep. 15, 1997

Related U.S. Application Data

[62] Division of Ser. No. 545,874, Oct. 20, 1995, Pat. No. 5,702,811.

[51] Int. Cl.[6] ..... B24D 3/34

[52] U.S. Cl. ..... 51/295; 51/307; 451/59

[58] Field of Search ..... 51/295, 298, 304, 51307, 308, 309, 293; 451/59

[56] References Cited

U.S. PATENT DOCUMENTS

| | | | |
|---|---|---|---|
| 1,830,757 | 11/1931 | Hartmann | 51/308 |
| 2,243,049 | 5/1941 | Kistler et al. | 51/295 |
| 2,410,506 | 11/1946 | Kirchner et al. | 51/188 |
| 3,175,894 | 3/1965 | Foot | 51/298 |
| 3,266,878 | 8/1966 | Timmer et al. | 51/298 |
| 3,476,537 | 11/1969 | Markotan | 51/296 |
| 3,996,702 | 12/1976 | Leahy | 51/328 |
| 4,420,532 | 12/1983 | Yamaguchi et al. | 428/329 |
| 4,541,842 | 9/1985 | Rostoker | 51/296 |
| 4,657,563 | 4/1987 | Licht et al. | 51/308 |
| 4,734,104 | 3/1988 | Broberg | 51/295 |
| 4,737,163 | 4/1988 | Larkey | 51/295 |
| 4,877,420 | 10/1989 | Buxbaum et al. | 51/309 |
| 5,009,674 | 4/1991 | Kunz et al. | 51/295 |
| 5,011,512 | 3/1991 | Wald et al. | 51/295 |
| 5,026,404 | 6/1991 | Kunz et al. | 51/295 |
| 5,037,453 | 8/1991 | Narayanan et al. | 51/307 |
| 5,078,753 | 1/1992 | Broberg et al. | 51/298 |
| 5,110,322 | 5/1992 | Narayanan et al. | 51/309 |
| 5,551,962 | 9/1996 | Ho | 51/306 |
| 5,578,098 | 11/1996 | Gagliardi et al. | 51/295 |
| 5,702,811 | 12/1997 | Ho et al. | 51/295 |

FOREIGN PATENT DOCUMENTS

| | | | |
|---|---|---|---|
| 802 150 | 2/1964 | Canada . | |
| 0 071 723 A3 | 2/1983 | European Pat. Off. | B24D 3/28 |
| 0 615 816 | 9/1994 | European Pat. Off. . | |
| 487287 | 6/1938 | United Kingdom . | |
| 826729 | 1/1960 | United Kingdom . | |
| 994484 | 6/1965 | United Kingdom . | |
| WO 92/05915 | 4/1992 | WIPO . | |

OTHER PUBLICATIONS

Kirk–Othmer Encyclopedia of Chemical Technology, 4th Edition, vol. 1, pp. 28–29 (1991).

Kirk–Othmer Encyclopedia of Chemical Technology, 3rd Edition, vol. 1, pp. 29–31 (1978).

Patent Abstracts of Japan, vol. 12, No. 466, AN. 88–261767 for Japanese Patent No. JP63191574, Aug. 9, 1988.

Patent Abstracts of Japan, vol. 17, No. 142, AN. 92–418273 for Japanese Patent No. JP4311772 (published Nov. 4, 1992).

Patent Abstracts of Japan, vol. 13, No. 163, AN. 89–051876 for Japanese Patent No. JP64002868 (published Jan. 6, 1989).

Derwent Abstract AN. 77–80174Y for Japanese Paetnt No. 52115493 (published Sep. 28, 1977).

Derwent Abstract AN. 93–141620 for Patent No. SU 1731795 (published May 7, 1992).

*Primary Examiner*—Deborah Jones

*Attorney, Agent, or Firm*—Doreen S.L. Gwin; Paul W. Busse

[57] ABSTRACT

A coated abrasive article comprised of a backing having a layer of grains adherently bonded thereto by a binding material, wherein the layer of grains comprises abrasive grains and nonabrasive composite grains, and the nonabrasive composite grains comprise inorganic nonabrasive particles bonded together by a binder selected from the group consisting of a metal salt of fatty acid, colloidal silica, and combinations thereof. The abrasive article has an unexpected abrading efficiency, performing equal to, or superior to, a coated abrasive article containing only abrasive grains. The invention also relates to a bonded abrasive article comprising the abrasive grains and nonabrasive composite grains adhered together.

5 Claims, 1 Drawing Sheet

HIGH PERFORMANCE ABRASIVE ARTICLES CONTAINING ABRASIVE GRAINS AND NONABRASIVE COMPOSITE GRAINS

This is a division of application Ser. No. 08/545,874 filed Oct. 20, 1995 U.S. Pat. No. 5,702,811.

BACKGROUND OF THE INVENTION

1. Field of the Invention

This invention relates to abrasive products comprising abrasive grains, binder, and nonabrasive composite grains, and to methods of making and using such products. These abrasive products include bonded abrasives, coated abrasives, and nonwoven abrasives.

2. Description of the Related Art

In the competitive and economically significant field of coated abrasive products, a continuing desire exists to reduce manufacturing costs and increase performance of such products in efforts to seek and acquire competitive edge.

Coated abrasive products typically have a backing substrate, abrasive grains, and a bonding system which operates to hold the abrasive grains to the backing. In a typical coated abrasive product, the backing is first coated with a layer of adhesive, commonly referred to as a "make coat", and then the abrasive grains are applied to the adhesive coating. The application of the abrasive grains to the make coat involves electrostatic deposition or a mechanical process which maximizes the probability that the individual abrasive particles are positioned with its major axis oriented perpendicular to the backing surface. As so applied, the abrasive particles optimally are at least partially embedded in the make coat. The resulting adhesive/abrasive grain layer is then generally solidified or set (such as by a series of drying or curing ovens) sufficient to retain the abrasive grains to the backing. After curing or setting the make coat, a second layer of adhesive, commonly referred to as a "size coat", is applied over the surface of the make coat and abrasive particles, and, upon setting, it further supports the particles and enhances the anchorage of the particles to the backing. Optionally, a "supersize" coat, which may contain grinding aids, can be applied over the cured size coat. In any event, once the size coat and supersize coat, if used, has been cured, the resulting coated abrasive product can be converted into a variety of convenient forms such as sheets, rolls, belts, and discs. As an optional enhancement, to mitigate any anticipated loading or clogging of the abrasive product with swarf (i.e., debris liberated from the workpiece during the abrading operation), a coating of anti-stick stearate also can be applied over the exterior of the abrasive coating, once formed, as suggested in *Kirk-Othmer Encyclopedia of Chemical Technology*. Fourth Ed., Vol. 1, (p. 29).

For many years fused aluminum oxide and silicon carbide were the primary abrasive grains used in coated abrasives. This has changed somewhat by the development of "premium" abrasive grains, such as sol-gel sintered aluminum oxide (commercially available from Minnesota Mining and Manufacturing Company of Saint Paul, Minn., under the trade designation "Cubitron"). The categorization of abrasive grains as being "premium" involves a term of art, which, for purposes of this application, has a meaning as defined in U.S. Pat. No. 5,011,512 (Wald et al.). Coated abrasive products containing premium abrasive grains generally out-perform coated abrasives containing fused aluminum oxide or silicon carbide in stock removal applications. However, the premium grains are costly in comparison to fused aluminum oxide or silicon carbide. Thus, an incentive exists to reduce the cost of coated abrasive products using premium abrasive grains without sacrificing performance.

With this objective in mind, assignee's U.S. Pat. No. 5,011,512 (Wald et al.) describes the use of a grain layer of premium abrasive grains in combination with nonabrasive inorganic diluent grains whose Knoop hardness is less than 200, such as marble. Wald et al. state that the nonabrasive inorganic diluent grains can be individual grains of inorganic diluent or multigrain aggregates of inorganic diluent bound together by means such as fusing, or binders. In the examples of that patent, abrasive grains and individual particles of marble, gypsum, pumice, as nonabrasive diluent grains were applied to a make coat of calcium carbonate-filled resole phenolic resin on a polyester backing. The resulting coated abrasive materials were precured, coated with size coat, final cured, and flexed, and belts of such coated abrasives were tested for abrasiveness on stainless steel workpieces. The categorization of grains as being "nonabrasive" grains involves a term of art, which, for purposes of this application, has a meaning as defined in U.S. Pat. No. 5,011,512 (Wald et al.).

In assignee's U.S. Pat. No. 5,078,753 (Broberg et al.), premium abrasive grains and erodible agglomerates comprising a resinous binder and inorganic, nonabrasive filler are adhered to a make coat on a backing, and a size coat applied to overlay the grains, agglomerates, and make coat. The ratio of size of the abrasive grains to the size of the erodible agglomerates in the so-prepared coated abrasive product in general ranges from 2.5:1 to 0.5:1. The materials described in Broberg et al. as being suitable for the resinous binder of the erodible agglomerates include phenolic resins, urea formaldehyde resins, urethane resins, polyester resins, acrylate resins, epoxy resins, and hide glue.

The above-discussed patents to Wald et al. and Broberg et al. represent noteworthy innovations in partnering nonabrasive diluents with premium grain without adversely impacting performance of the coated abrasive. As will be understood from detailed descriptions of the invention hereinafter, however, the present invention advances the technology further yet by developing an alternative and advantageous diluent material useful in combination with abrasive grains.

In addition to Wald et al and Broberg et al., identified supra, the combined usage of abrasive grains and various nonabrasive grains or other particles for coated abrasives also has been suggested in other publications. Examples of which include the following:

U.S. Pat. No. 1,830,757 (Hartmann), which discloses abrasive articles, both bonded and coated, comprised of a mixture of abrasive particles having a Mohs' hardness greater than 9 and friable particles having a Mohs' hardness less than 9. During grinding, the friable grains are said to break apart and leave holes or depressions over the grinding face which results in an open, sharp-cutting surface that improves the abrasive action. The friable particles disclosed include calcined clay, porous clay grog, diamotaceous earth, porous alumina, corundum, flint, magnesia, and glass. Also U.S. Pat. No. 5,110,322 (Narayanan et al.) discloses certain friable particles as diluents for abrasive particles in a bonded abrasive.

U.S. Pat. No. 3,476,537 (Markotan), which discloses abrasive particles, both bonded and coated, in which porosity has been induced by the addition, to the abrasive composition, of a granular agent approximating the abrasive grains in size but softer than the abrasive grains. The porosity inducing agent reportedly may be selected from limestone, natural or activated bauxite, and minerals such as olivine, gypsum, chromite, coquimbite, pyrolusite, molybdenum, galena, halite, and the like, as well as a variety of products manufactured for a similar purpose.

U.S. Pat. No. 3,266,878 (Timmer et al.), which discloses a coated abrasive product wherein diamonds are diluted with particles having a Mohs' hardness between 4.0 to 8.5. The diluent particles include flint, garnet, emery, ground glass and ground resin.

Canadian Patent No. 802,150 (Caldwell), published Feb. 11, 1964, which discloses a coated abrasive comprising diamond abrasive grains blended with granules having a Knoop hardness in the range of 200 to 600, such as greystone.

WO 92/05915 (Cosmano et al.), which discloses a coated abrasive having abrasive grains and erodible agglomerates bonded to a backing. The erodible agglomerates consist essentially of a grinding aid and optionally a binder. The erodible agglomerates are each either a large individual grinding aid particle or a mixture of grinding aid particles bonded together.

Commonly assigned U.S. patent application Ser. No. 08/214,394, filed Mar. 16, 1994, which describes abrasive articles having a peripheral (outermost) coating comprised of grinding aid particles and a binder, where the grinding aid particles are individually coated with an inert, hydrophobic, hydrocarbon-containing substance. For coated abrasive articles, the peripheral coating is stated to refer to either the size or supersize coat that is the outermost coating on the abrasive surface of the article. The individually-coated grinding aid particles also may be incorporated into erodible grinding aid agglomerates, with a binder to adhere the grinding aid particles together, and these agglomerates can be incorporated into the make, size and/or supersize coats of a coated abrasive.

Additionally, brown alumina has been used as a diluent for grains available from Minnesota Mining and Manufacturing Company, St. Paul, Minn., under the trade designation "Cubitron" in abrasive products. However, the brown alumina does not give properties of low hardness nor impart grinding aid effects. U.S. Pat. Nos. 4,737,163 (Larkey) and 4,734,104 (Broberg) disclose abrasive grain mixtures.

European Published Pat. Appln. No. 0 615 816 (Broberg) teaches a coated abrasive article comprising a backing having a plurality of shaped abrasive grains and a plurality of diluent particles bonded to the backing by means of a binder. The diluent particles can be (1) a plurality of individual abrasive particles bonded together by an adhesive to form an agglomerate, (2) a plurality of individual nonabrasive particles bonded together by an adhesive to form an agglomerate, (3) a plurality of individual abrasive particles bonded together by an adhesive to form an agglomerate, (4) individual non-abrasive particles, or (5) individual abrasive particles or combinations thereof.

SUMMARY OF THE INVENTION

The present invention provides abrasive articles having excellent abrading effectiveness, utilizing advantages inherent in abrasive grains, while decreasing the quantity of such abrasive grains actually employed and needed. Indeed, in some instances, synergistic effects are obtained, the construction actually performing better than abrasive articles in which only the abrasive grain is present.

In one aspect of this invention, there is a coated abrasive article comprising a backing having a layer of grains adherently bonded thereto by a binding material, wherein said layer of grains comprises abrasive grains and nonabrasive composite grains, and said nonabrasive composite grains comprise inorganic nonabrasive particles bonded together by a binder selected from the group consisting of a metal salt of a fatty acid and colloidal silica, and combinations thereof.

Further, the aforesaid nonabrasive composite grains themselves form an inventive aspect of the invention, i.e., the present invention also relates to nonabrasive composite grains comprising inorganic nonabrasive particulate and a binder therefor which is selected from the group consisting of a metal salt of a fatty acid, colloidal silica, and combinations thereof Another aspect of the invention is a blend of the nonabrasive composite grains with the abrasive grains, i.e., a blend of abrasive grains and nonabrasive composite grains comprising inorganic nonabrasive particulate and a binder therefor which is selected from the group consisting of a metal salt of a fatty acid, colloidal silica, and combinations thereof.

In a further aspect, a peripheral (i.e., an "outermost") coating is formed on the aforesaid layer of grains of the coated abrasive article, where the peripheral coating is a size coat (no supersize) or a supersize coat that does not contain the inventive nonabrasive composite grains. Nonetheless, by instead partnering the inventive nonabrasive composite grains with the abrasive grains in the grain layer of a coated abrasive, the present invention unexpectedly has been found to provide a means to reduce the quantity of abrasive grains needed in the grain layer of a coated abrasive article without sacrificing abrading efficacy.

In another further aspect, the aforesaid nonabrasive composite grains will have an average size within a factor of two, i.e. between 0.5x and 2x, of the average size of the abrasive grains adhered to the backing (i.e., x is the average size of the abrasive grains). Such sizing of the nonabrasive particles is significantly larger than that of conventional inorganic fillers used in make coats and the like, and this sizing allows for the nonabrasive particles to be partially embedded along with abrasive particles in the surface of the make coat and thus form a part of the grain layer (as opposed to forming part of the bulk of a make, size, or supersize coat layer).

In another aspect, the invention provides a method for making the aforesaid coated abrasive article, comprising the steps of:

(a) applying a make coat binder precursor to a backing;

(b) applying a plurality of abrasive grains and nonabrasive composite grains to said make coat binder precursor, wherein said nonabrasive composite grains comprise a plurality of inorganic nonabrasive particles bonded together by a binder selected from the group consisting of a metal salt of a fatty acid, colloidal silica, and combinations thereof; and (c) curing said make coat binder precursor to adherently bond thereto said plurality of abrasive grains and nonabrasive composite grains.

In a further aspect of this method, a size coat layer, with or without a supersize coat, which does not contain the inventive nonabrasive composite grains, can be formed on the nonabrasive composite grains and abrasive grains after step (c), to further anchor the grains to the construction.

The incorporation of the nonabrasive composite (diluent) grains into the coated abrasive article of the present invention endows the abrasive article with an unexpected abrading efficiency when compared to a similar coated abrasive containing a full loading of abrasive grains, despite the drastic reduction in the proportion of abrasive grains in the coated abrasive article of the invention. Since the nonabrasive composite grains of this invention are generally less expensive than the abrasive grains, the coated abrasive articles of the present invention are less expensive than coated abrasives articles containing a full loading of abrasive grains, especially premium abrasive grains, with no diluent.

It is to be understood that the abrasive article of the invention includes not only a coated abrasive article, but also bonded abrasives. Bonded abrasives comprise a shaped mass of abrasive grains and the aforesaid nonabrasive composite grains adhered together by a binder, which can be organic, metallic or vitrified. In metallic or vitrified grinding wheels, colloidal silica binders are preferred. Thus, the present invention relates to a bonded abrasive article comprising a shaped mass, wherein said shaped mass comprises a plurality of abrasive particles and nonabrasive composite grains adhered together with a first binder, wherein said nonabrasive composite grains comprise inorganic nonabrasive particles bonded together by a second binder selected from the group consisting of a metal salt of a fatty acid and colloidal silica, and combinations thereof. The bonded abrasive can be molded and shaped into a wide variety of useful grinding shapes before completing curing of the binder, such as including a grinding wheel shape or a conical shape.

The present invention also relates to a method of grinding titanium, comprising:

(a) providing a workpiece comprising titanium and a coated abrasive article comprising: a backing having a layer of grains adherently bonded thereto by a binding material, wherein said layer of grains comprises abrasive grains and nonabrasive composite grains, and said nonabrasive composite grains comprise sodium metaphosphate particles bonded together by a binder selected from the group consisting of a metal salt of a fatty acid, colloidal silica, and combinations thereof;

(b) frictionally engaging said coated abrasive article with a surface of said workpiece; and (c) moving said coated abrasive article relative to said workpiece surface effective to reduce said surface.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE INVENTION

Figure 1:
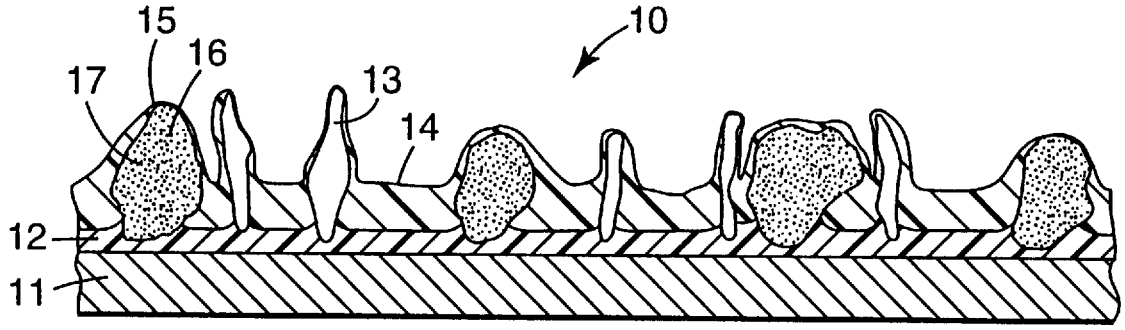
FIG. 1 is a schematic representation of a cross-section of one embodiment of a coated abrasive product of this invention.

The coated abrasive products of the present invention generally include conventional backings and binders for the make and any size coats, and an abrasive material which is diluted with nonabrasive composite grains.

As will be shown, coated abrasive products of this invention have been found to be of high performance in abrading workpieces such as high nickel alloys, tungsten alloys, stainless steel (SAS 304), and titanium. For example, in some instances such products containing approximately equal parts (by volume) of premium abrasive grains, such as those available from Minnesota Mining and Manufacturing Company, St. Paul, Minn., under the trade designation, "Cubitron 321" made from ceramic aluminum oxide, and nonabrasive composite grains, such as those comprising $KBF_4$, calcium carbonate, cryolite and $NaPO_3$ particles dispersed in a binder matrix of zinc stearate, displayed equal to improved abrasion efficiency over conventional coated abrasive product containing twice as much (a full loading) of the "Cubitron 321" abrasive grains. This abrasion efficiency depends in part on the abrading application and the other components forming the abrasive article. Moreover, the coated abrasive product of this invention was also unexpectedly found to have far less unused grain layer (or waste) than the unused grain layer of the conventional coated abrasive product. The cost advantages of that feature can be augmented by the savings resulting from the use of the nonabrasive particulate which generally will be far less in cost than the abrasive grain, especially premium abrasive grains.

The coated abrasive products of this invention can make use of backings, make coats, abrasive grains, size coats, supersize coats, and optional adjuvants, such as grinding aids, fillers, and other additives, which are known or conventional in making coated abrasive products; such materials or substances and their forms and use are described, for example, in *Kirk-Othmer, loc. cit*, p. 17–37, McKetta, J. J., Cunningham, W. A., *Encyclopedia of Chemical Processing and Design*, Marcel Dekker, Inc., p. 1–19, and said U.S. Pat. Nos. 5,011,512 and 5,078,753, which descriptions are incorporated herein by reference.

The backing used as a base or substrate for the coated abrasive products of this invention generally will be made of a sheet or film of a material that is compatible with the make coat and other elements or components of the abrasive product and that is capable of maintaining its integrity during fabrication and use of the abrasive product. Examples of backing materials are paper, fiber, polymeric film, woven and nonwoven fabric or cloth, and vulcanized fibre. Still other examples of backings are disclosed in U.S. Pat. No. 5,316,812 (Stout) and European Patent Publication No. 0 619 769 (Benedict et al.). Specific weights, tensile strengths, and characteristics of some of such backings are set forth on p. 4 of the McKetta and Cunningham text, loc. cit. The backing may also contain a treatment or treatments to seal the backing, for example, to make them waterproof, and modify physical properties thereof. Also, reference is made to U.S. Pat. No. 5,011,512 describing specific, woven, polyester cloth backings of certain weights and saturated with a calcium carbonate-filled latex/phenolic resin coating (useful also as a make coat). The backing may also have an attachment means on its back surface to secure the resulting coated abrasive to a support pad or back-up pad. This attachment means can be a pressure sensitive adhesive or a loop fabric for a hook and loop attachment. Alternatively, there may be an intermeshing attachment system as described in the said U.S. Pat. No. 5,201,101. The back side of the abrasive article may also contain a slip resistant or frictional coating. Examples of such coatings include an inorganic particulate (e.g., calcium carbonate or quartz) dispersed in an adhesive.

The make and size coats generally will be resinous binder or adhesive. The resinous adhesive generally will be selected such that it has the suitable properties necessary for an abrasive article binder. Examples of typical resinous adhesives useful in this invention include phenolic resins, aminoplast resins having pendant $\alpha,\beta$-unsaturated carbonyl groups, urethane resins, epoxy resins, ethylenically-unsaturated resins, acrylated isocyanurate resins, urea-formaldehyde resins, isocyanurate resins, acrylated urethane resins, acrylated epoxy resins, bismaleimide resins, fluorene modified epoxy resins, and mixtures thereof. Phenolic resins are widely used in abrasive article binders because of their thermal properties, availability, cost and ease of handling. There are two types of phenolic resins, resole and novolac, and they can be used in this invention. Resole phenolic resins have a molar ratio of formaldehyde to phenol, of greater than or equal to 1:1, typically between 1.5:1.0 to 3.0:0. Novolac resins have a molar ratio of formaldehyde to phenol of less than one to one. Examples of commercially-available phenolic resins include those available from Occidental Chemical Corp., Tonawanda, N.Y., under the trade designations "Durez" and "Varcum"; those available from Monsanto Co., St. Louis, Mo., under the trade designation "Resinox"; and those available from Ashland Chemical, Inc., Columbus, Ohio, under the trade designations "Arofene" and "Arotap".

The aminoplast resins which can be used as binders in the make and size coats have at east one pendant (α,β-unsaturated carbonyl group per molecule or oligomer. These materials are further described in U.S. Pat. Nos. 4,903,440 and 5,236,472, of which descriptions both are incorporated herein by reference.

Epoxy resins useful as binders in the make coats have an oxirane ring and are polymerized by the ring opening. Such epoxide resins include monomeric epoxy resins and polymeric epoxy resins. These resins can vary greatly in the nature of their backbones and substituent groups. For example, the backbone may be of any type normally associated with epoxy resins and substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups and phosphate groups. Examples of some preferred epoxy resins include 2,2-bis[4-(2,3-epoxypropoxy)phenyl] propane (diglycidyl ether of bisphenol) and commercially available materials available from Shell Chemical Co., Houston, Tex., under the trade designations "Epon 828", "Epon 1004", and "Epon 1001F" and Dow Chemical Co., Midland, Mich., under the trade designations "DER 331", "DER 332", and "DER 334". Aqueous emulsions of the diglycidyl ether of bisphenol A have from about 50 to 90 wt. % solids, preferably 50 to 70 wt. % solids, and further comprise a nonionic emulsifier. An emulsion meeting this description is available from Shell Chemical Co., Louisville, Ky., under the trade designation "CMD 35201". Such aqueous epoxy emulsions are described as binder for grinding aids in EP 0 486 308 (Lee et al.), which is incorporated herein by reference. Other suitable epoxy resins include glycidyl ethers of phenol formaldehyde novolac (e.g., available from Dow Chemical Co., Midland, Minn., under the trade designations "DEN 431" and "DEN 438").

Ethylenically-unsaturated resins which can be used in the make and size coats of this invention include both monomeric and polymeric compounds that contain atoms of carbon, hydrogen and oxygen, and optionally, nitrogen and the halogens. Oxygen or nitrogen atoms or both are generally present in ether, ester, urethane, amide, and urea groups. The ethylenically-unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically-unsaturated resins include those made by polymerizing methyl methacrylate, ethyl methacrylate, styrene, divinylbenzene, vinyl toluene, ethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate, or pentaerythritol tetramethacrylate, and mixtures thereof. Other ethylenically-unsaturated resins include those of polymerized monoallyl, polyallyl, and polymethallyl esters and amides of carboxylic acids, such as diallyl phthalate, diallyl adipate, and N,N-diallyladipamide. Still other polymerizable nitrogen-containing compounds include tris(2-acryloxyethyl)isocyanurate, 1,3,5-tri-(2-methacryloxyethyl)-s-triazine, acrylamide, methylacrylamide, N-methylacrylamide, N,N-dimethylacrylamide, N-vinylpyrrolidone, and N-vinylpiperidone.

Acrylated urethanes are diacrylate esters of hydroxy terminated isocyanate extended polyesters or polyethers. Examples of commercially available acrylated urethanes which can be used in the make and size coats include those available from Radcure Specialties Inc., Atlanta, Ga., under the trade designations "UVITHANE 782", "CMD 6600", "CMD 8400", and "CMD 8805". Acrylated epoxies which can be used in the make and size coats are diacrylate esters of epoxy resins, such as the diacrylate esters of bisphenol A epoxy resin. Examples of commercially available acrylated epoxies include those available from Radcure Specialties Inc., Atlanta, Ga., under the trade designations "CMD 3500", "CMD 3600", and "CMD 3700".

Bismaleimide resins which also can be used in the make and size coats are further described in U.S. Pat. No. 5,314,513 (Miller et al.), which description is incorporated herein by reference.

Examples of abrasive particles or grains useful in this invention include aluminum oxide, fused alumina zirconia, silica, tin oxide, garnet, ceria, flint, chromia, titanium diboride, boron carbide, diamond, iron oxide, silicon carbide, green silicon carbide, garnet, cubic boron nitride (CBN), boron carbide, and combinations thereof. The term abrasive grains also encompasses single abrasive particles bonded together to form an abrasive agglomerate. Abrasive agglomerates are described in U.S. Pat. Nos. 4,311,489; 4,652,275; and 4,799,939; which descriptions are incorporated herein by reference. The term aluminum oxide includes fused alumina, heat treated alumina, sintered alumina, such as sol-gel alpha alumina-based abrasive grains, fused aluminum oxide (which includes brown aluminum oxide, heat treated aluminum oxide, and white aluminum oxide), and ceramic aluminum oxide.

In some instances, it is preferred to use a premium abrasive grain. Abrasive grains which can be used in the abrasive articles of this invention include those that are often categorized according to their ability to abrade a surface. Abrasive grains capable of quickly abrading a surface are denoted "premium." The test to categorize abrasive grains as "premium" or "nonabrasive" is described in said U.S. Pat. No. 5,011,512, which is incorporated herein by reference.

Premium abrasive grains useful in this invention include alpha alumina-based ceramic materials, such as those disclosed in U.S. Pat. Nos. 4,314,827; 4,518,397; 4,574,003; 4,623,364; 4,744,802; 4,770,671; 4,881,951; 5,011,508; 5,291,591; 5,201,916; and 5,304,331; and EP publication 228,856; fused alumina-zirconia, such as disclosed in U.S. Pat. Nos. 3,781,408 and 3,893,826; refractory coated silicon carbide, such as disclosed in U.S. Pat No. 4,505,720; diamond; diamond-like carbon; cubic boron nitride; and blends or combinations thereof. One preferred abrasive grain comprises alpha alumina, rare earth metal oxides and magnesia. This abrasive grain can be made according to the teachings of U.S. Patent No. 4,881,951, incorporated hereinafter by reference.

The abrasive grains to be used in this invention typically have an average particle size ranging from about 0.1 to 1500 micrometers, usually between about 1 to 500 micrometers. It is preferred that the abrasive particles have a Mohs' hardness of at least about 8, more preferably above 9.

It is also within the scope of this invention to have a surface coating on the abrasive grains. The surface coating may have many different functions. In some instances the surface coatings increase adhesion to the binder or alter the abrading characteristics of the abrasive grain or particle. Examples of surface coatings include coupling agents, halide salts, metal oxides such as silica, refractory metal nitrides, and refractory metal carbides.

The key aspect of this invention is the mixture of the abrasive grains and nonabrasive composite grains. The nonabrasive composite grains comprise inorganic nonabrasive particles adhered together by a binder.

Examples of nonabrasive inorganic particulates used in making the nonabrasive composite grains of the invention are metal carbonates, such as calcium carbonate ($CaCO_3$ in forms of chalk, calcite, marble, travertine, marble and limestone), potassium tetrafluoroborate ($KBF_4$), sodium cryolite ($Na_3AlF_6$), sodium metaphosphate ($NaPO_3$), sodium chloride, potassium cryolite, ammonium cryolite, sodium tetrafluoroborate, silicon fluoride, potassium chloride, magnesium chloride, metals (such as tin, lead, bismuth, cobalt, antimony, cadmium, iron, and titanium), sulfur, graphite, metallic sulfides, calcium magnesium carbonate, sodium carbonate, magnesium carbonate, silica (such as quartz, glass beads, glass bubbles and glass fibers), silicates (such as talc, clays, e.g., montmorillonite, feldspar, mica, calcium silicate, calcium metasilicate, sodium aluminosilicate, and sodium silicate), metal sulfates (such as calcium sulfate, barium sulfate, sodium sulfate, aluminum sodium sulfate, and aluminum sulfate), gypsum, vermiculite, aluminum trihydrate, metal oxides (such as calcium oxide or lime, aluminum oxide, titanium dioxide), and metal sulfites (such as calcium sulfite). The terminology "inorganic", as used herein, includes metal carbonate compounds. These inorganic particulates can range in particle size from about 0.01 to 1,000 micrometers, typically 0.1 to 100 micrometers.

Binders used to bind and consolidate a plurality of the nonabrasive particulates (viz., a plurality of individual particles thereof) used in the composite grains of the invention include fatty acid metal salts. The fatty acid is, in general, a long straight or substantially straight-chain hydrocarbon including a carboxylic acid group and at least 8 carbon atoms, preferably 8 to 20 carbon atoms. The fatty acid can be saturated or unsaturated. If the fatty acid is saturated, its salt can be represented by the formula $CH_3(CH_2)_xCO_2M$, where x can be between 6 and 18 and the metal atom M can be selected from the group consisting of zinc, calcium, lithium, aluminum, nickel, lead, barium and the like. If x is 16, then a stearate salt is formed; likewise if x is 14, a palmitate salt is formed; if x is 6, an octanoate salt is formed. The fatty acid can also be unsaturated, as in the case of a undecylenate salt, $CH_2{=}(CH_2)_8CO_2M$ and a oleate salt, $CH_3(CH_2)_7CH{=}CH(CH_2)_7CO_2M$. Stearic acid is the preferred fatty acid. A mixture of fatty acids can be used, such as that commonly encountered in currently-available commercial sources of "stearic acid".

The softening points of the above-described fatty acid salts are greater than 100° C. It is preferred in this invention to use metal salts of a fatty acid that have a high softening point. During abrading applications a considerable amount of heat can be generated. This heat may soften the loading-resistant coating to the point that the performance of the coated abrasive is substantially reduced and may cause the coating to smear on the workpiece being abraded. Metal stearates have a softening point in the range of 110°–212° C.

The metal salt of a fatty acid is in general insoluble in water and sparingly soluble in organic solvents, such as ketones, esters, alcohols, and mixtures thereof. However, if an appropriate surfactant is employed, the metal salt of a fatty acid can be rendered dispersible in water. It is preferred to use water as the solvent instead of organic solvents to minimize the environmental concerns associated with solvent removal. In general, the amount of the surfactant contained is between 0.01 to 10 wt. % of the total formulation of nonabrasive particulate, metal salt of fatty acid, and surfactant, that is to be used to make the nonabrasive composite grains. Typical examples of surfactants which can be used are polyoxyethylene alkylphenolether, sodium alkylsulfate, polyoxyethylene alkyl ester, polyoxyethylene alkyl ether, polyhydric alcohol esters, polyhydric ester ethers, sulfonates, or sulfosuccinates. The surfactant can be added directly to the nonabrasive composite-forming formulation, or the metal salt of the fatty acid can be pretreated with the surfactant and then added to the formulation.

The nonabrasive composite grains of this invention can be prepared by stirring or otherwise mixing a dispersion of the inorganic, nonabrasive particulate, e.g., $KBF_4$, in an aqueous solution or dispersion of the binder therefor, e.g., zinc stearate, $Zn(Cl_{18}H_{35}O_2)_2$, gelling the resulting mixture of particulate and binder, drying such mixture, and grinding, crushing, or otherwise pulverizing or shaping and classifying the resulting dry solid to form a particulate or grain product. Such product can be applied to the make coat layer on a suitable backing or can be blended with the abrasive grains and the resulting blend so-applied together onto the make coat.

Colloidal silica or silica sol are also useful as binders for the nonabrasive particulates of the composite grains of this invention. These sols are stable dispersions of amorphous silica particles in water. Commercial products contain silica particles with diameters of about 3–100 nm and specific surface area of 50–270 $m^2/g$, with a silica content of 15–50 wt. %. They contain small amounts (<1 wt. %) of stabilizers, most commonly sodium ions. Their pH should be above 7 to maintain the negative charge on the silica particles that prevent aggregation. This surface charge is neutralized by soluble salts that ionize and form a double layer around the silica surface, which then allows aggregation; therefore, sols are only stable at low salt concentration.

Also, the fatty acid metal binders and colloidal silica binders of the invention can be combined and used together. For example, nonabrasive composite grains of $KBF_4$ (as the nonabrasive inorganic particle) and zinc stearate (as a first binder) can be prepared by adding $H_2O$ to a 45 wt. % aqueous dispersion of zinc stearate (99.9% passes through 325 mesh) available from Witco Corp., New York, N.Y., under the trade designation "AQ-90", in a mixing ratio of about 1:6 (wt. $H_2O$/wt. aqueous dispersion of zinc stearate), respectively. Then, $KBF_4$ is added to the "AQ-90" dispersion with good stirring in a mixing ratio of about 1:0.6 (wt. $KBF_4$/wt. aqueous dispersion of zinc stearate), respectively. Additional water typically will be judiciously added to facilitate mixing. Then, a colloidal silica sol, such as a colloidal silica sol available from Nyacol Products Inc., Ashland, Mass., under the trade designation "NY-215" (15% solids, pH=11, particle size of 3 to 4 nm), is added as a second binder to the mixture in a mixing ratio of about 1:5 (wt. colloidal silica sol/wt. $KBF_4$), respectively, relative to the amount of $KBF_4$ previously added. The resulting wet solid mix is dried in a tray at about 80° C. overnight. The dried solid is allowed to cool to about room temperature, crushed, and graded to desirable grit sizes. The fines can be collected and recycled.

The nonabrasive composite grains of the invention should not be confused with organic diluents or inorganic fillers which are sometimes used in the bond system of coated abrasives, i.e., make, size or supersize coats. The nonabrasive composite grains are significantly larger than inorganic fillers and are a part of the grain layer, not a part of the bond system. For example, it is preferable to employ nonabrasive composite grains having an average size, as a lower limit, that is within an order of magnitude of the average size of the abrasive grains (i.e., within a factor of 2 of the average size of the abrasive grains) co-present in the grain layer applied to the make coat. On the other hand, if the size of the nonabrasive composites substantially exceeds that of the abrasive grains, it might frustrate the abrading action desired from the coated abrasive. With these constraints in mind, the respective sizing of the abrasive and nonabrasive composite grains of the invention, in one embodiment, is expressed by the relationship where the average particle size of the abrasive grains is a value x in micrometers, and the average particle size of the nonabrasive composite grains is a value y in micrometers, where the numerical value of the ratio y/x ranges from about 0.5 to about 2. For example, if the abrasive grains have an average size of 100 micrometers, the nonabrasive composite grains have a size in the range of about 50 micrometers to about 200 micrometers. Such sizing of the nonabrasive particles is significantly larger than that of conventional inorganic fillers used in the bond system (i.e., make, size and supersize coats) and the like, and this sizing allows for the nonabrasive particles to be partially embedded along with abrasive particles in the surface of the make coat and thus form a part of the grain layer (as opposed to only forming part of the bulk of the bond system of the coated abrasive). It is also possible to shape the nonabrasive composite grains, before the consolidating binder is cured, into three dimensional shapes such as rods, triangles, pyramids, blocks, and so forth.

Typically, very soft materials do not function as abrasive grains. Thus, the discovery that abrasive articles containing blends of abrasive grains with the nonabrasive composite grains exhibit, in some abrading applications, abrading characteristics equal to, or superior to, abrasive articles containing only or a full loading of abrasive grains, is thought to be unexpected. Also unexpected is the amount by which the abrasive grains in a sense can be diluted without a significant reduction of the coated abrasive products abrading characteristics for some abrading applications. The preferred amount of composite grains used in this invention is from about 10 to 80% by volume based on a total volume of 100% of all grain materials in the grain layer. However, coated abrasive articles of this invention containing 50% by volume nonabrasive composite grains, in some abrading applications, have performance characteristics equal or superior to those containing only abrasive grains.

Nonabrasive composite grains of the invention generally comprise 5 to 90 wt. % inorganic particulate (e.g., calcium carbonate) and 10 to 95 wt. % binder, and preferably 10 to 80 wt. % inorganic particulate and 20 to 90 wt. % binder. The nonabrasive composite grains are generally less expensive than conventional abrasives, such as fused aluminum oxide and silicon carbide, and significantly less expensive than premium grains such as fused alumina-zirconia and alpha alumina-based ceramic materials. Thus, the abrasive articles of this invention are generally less expensive to make than abrasive articles made with only abrasive grain. In some cases the cost of making an abrasive article of this invention is equal to, or less than, the cost of making an abrasive article having conventional abrasive grains, while the abrasive article of this invention may have an abrading efficiency essentially equal to, or superior to, an abrasive article made of only abrasive grains. As understood in the field, the abrading performance is also dependent upon many factors such as workpiece type, abrasive speed, pressure, and the like.

The nonabrasive composite grains of the present invention also are "erodible", meaning that the composite grain has the ability to break down in a controlled manner, for example, by fracture due to mechanical stress and/or by dissolving fully or in part under wet grinding conditions. "Wet" means grinding conditions where a water spray or flood is used.

The nonabrasive composite grains can further comprise optional additives, such as, for example, fillers (including grinding aids), fibers, lubricants, wetting agents, thixotropic materials, surfactants, pigments, dyes, antistatic agents, coupling agents, plasticizers, and suspending agents. The amounts of these materials are selected to provide the properties desired. The bond system of the coated abrasive, viz. the make coat, size coat, and/or supersize coat and the like, also can contain such adjuvants with the primary component thereof, i.e., the binder precursor, with the proviso that it does not contain the inventive nonabrasive composite grains.

Grinding aids, or active fillers, may also be added to the size coat precursor (i.e., the uncured, undried size coat) or as a particulate material. The preferred grinding aid is either potassium fluoroborate ($KBF_4$) or sodium metaphosphate, although other grinding aids such as sodium chloride, sulfur, potassium titanium fluoride, polyvinyl chloride, polyvinylidene chloride, cryolite, and combinations thereof, also may be useful. The preferred amount of grinding aid is on the order of 50 to 300, preferably 80 to 160, grams per square meter of abrasive article surface.

Examples of antistatic agents which can be incorporated into the abrasive articles of the invention are graphite, carbon black, vanadium oxide, and humectants. These antistatic agents are described, for example, in U.S. Pat. Nos. 5,061,294; 5,137,542; and 5,203,884; which descriptions are incorporated herein by reference.

As another optional adjuvant for the make and/or size coats, a coupling agent can provide an association bridge between the binder precursor and the filler particles or abrasive particles. Examples of coupling agents include silanes, titanates, and zircoaluminates, and their manner of use for this function is described, for example, in U.S. Pat. No. 4,871,376 (DeWald). The abrasive bond preferably contains from about 0.01 to 3 wt. % coupling agent. It is also within the scope of this invention to have a coating between the make and size coats, or between the size and supersize coats. This coating typically is a relatively thin in thickness in comparison to the make and size coats. This extra coating can comprise a metal salt of a fatty acid, such as zinc stearate.

It is also within the scope of this invention to include a coating between the traditional make and size coats. This coating can be, for instance, a metal salt of a fatty acid, such as zinc stearate.

The manipulative steps of the process for making the abrasive articles of the invention can be essentially the same as those currently practiced in the art. For instance, the make coat precursor, comprising the resinous binder, is applied in liquid or flowable form to the backing, followed by the application of the abrasive and nonabrasive composite grains to the applied make coat. The premium abrasive grains and nonabrasive composite grains can either be blended together and coated simultaneously, or alternatively, applied sequentially one after the other, into the make coat.

In the blending method, the two types of grains can be charged to a mixer and blended; then the resulting mixture of grains can be electrostatically projected or drop-coated onto the wet make coat. In this first method, the resulting abrasive article has the abrasive grains and nonabrasive grains present in a side by side manner, as illustrated by FIG. 1. In this method, a make coat precursor, i.e. a coating comprising an uncured resinous binder, is applied to a backing. Then, the two types of grains are charged to a mixer and blended; then the resulting mixture of grains is electrostatically projected or drop-coated onto the make coat. After the addition of the nonabrasive composite grains and abrasive grains to the make coat precursor, the make coat precursor is at least partially cured, i.e., cured sufficiently to secure the grains to the backing, in order that a size coat precursor can be applied. Notably, if a thermoplastic resin is used alone for any bond system, the thermoplastic resin can be dried in order to solidify. Thus, for the purpose of this application, the term "cure" refers to the polymerization, gelling, or drying procedure necessary to convert a binder precursor into a binder. Therefore, "at least partially curing" refers to at least partially polymerizing, gelling, or drying a binder precursor.

The size coat precursor can then be applied, and the size coat precursor and, if necessary, the make coat precursor, can be fully cured. An optional supersize coat precursor, which may contain a grinding aid, can be applied. The application of a supersize coat precursor can occur when the make and size coats are fully or at least partially cured. The make and size coats can be cured either by drying or the exposure to an energy source such as thermal energy, or radiation energy including electron beam, ultraviolet light and visible light. The choice of the energy source will depend upon the particular chemistry of the resinous adhesive.

It is within the scope of this invention to have (1) coated agglomerate grains along side of abrasive grains; (2) agglomerate grains coated underneath abrasive grains; (3) agglomerate grains coated over abrasive grains; and (4) combinations thereof.

As shown in FIG. 1, coated abrasive article 10 comprises a backing 11. Overlying backing 11 is a make coat 12 to which are adhered at least partially embedded individual abrasive grains 13 and nonabrasive composite grains 15. A size coat 14 has been applied over the make coat 12, abrasive grains 13, and nonabrasive composite grains 15. Nonabrasive composite grains comprise a binder 16 and inorganic nonabrasive particulate 17.

Figure 2:
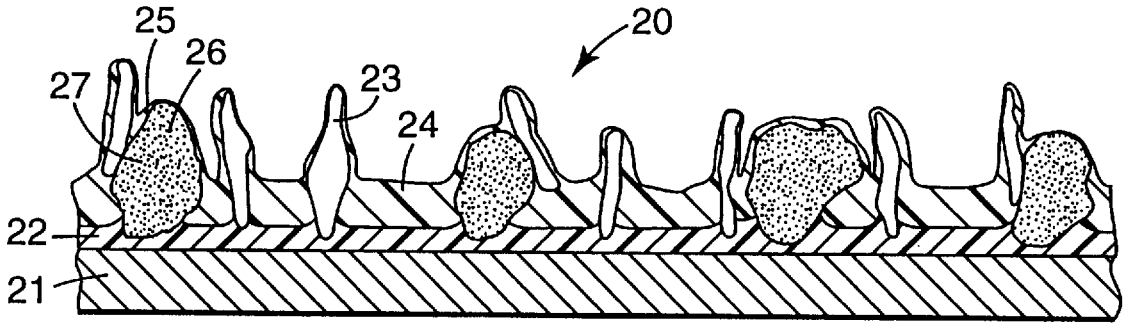
FIG. 2 is a schematic representation of a cross-section of another embodiment of a coated abrasive product of this invention.

In the second method, the nonabrasive composite grains can be drop-coated into a make coat precursor and the abrasive grains are thereafter electrostatically projected or drop-coated, as shown in FIG. 2. The curing schemes and application of the size and optional supersize are the same as those described above in connection with the first method. As shown in FIG. 2, coated abrasive article 20 comprises a backing 21. Overlying backing 21 is a make coat 22 to which are adhered at least partially embedded both nonabrasive composite grains 25, and a portion of the individual abrasive grains 23 that are disposed between the nonabrasive composite grains 23. The remainder portion of the individual abrasive grains 25 are present overlying the nonabrasive composite grains 23 without being partially embedded in the make coat 22. A size coat 24 has been applied over the make coat 22, abrasive grains 23, and nonabrasive composite grains 25.

Nonabrasive composite grains comprise a binder 26 and inorganic nonabrasive particulate 27.

The coated abrasive products of the present invention are not limited as to the types of workpiece that can be abraded therewith. By "abrading", the term as used herein generally can mean any of grinding, polishing, finishing, and the like. The workpiece surfaces made of wood, metal, metal alloy, plastic, ceramic, stone, and the like, can be abraded by the coated abrasive products of the present invention. The coated abrasive products of this invention are particularly well-suited for metal grinding operations. For example, coated abrasives of the invention where the nonabrasive composite grains are comprised of halogenated grinding aid, e.g., $KBF_4$, and a fatty acid salt binder, as electrostatically deposited into a make coat precursor as a blend with the abrasive grains, are particularly effective in grinding metals such as stainless steel, titanium, mild steel, or other exotic alloy workpieces. In the same circumstances as above, except where inorganic phosphate grinding aid, e.g. $NaPO_3$, is used in the nonabrasive particle, the coated abrasive is highly useful for titanium grinding.

Also, the coated abrasive products of the present invention can be readily converted into various geometric shapes to suit the contemplated application, such as discrete sheets, disc forms, endless belt forms, conical forms, and so forth, depending on the particular abrading operation envisioned. The abrasive articles can be flexed and/or humidified prior to use.

While this invention has been illustrated herein in greater detail by reference to coated abrasive articles, it is to be understood that the abrasive article of the invention includes not only a coated abrasive article, but also bonded abrasives and nonwoven abrasives. Bonded abrasives comprise a porous, shaped mass of abrasive grains and the nonabrasive composite grains of this invention adhered together by a binder, which can be organic, metallic or vitrified. The bonded abrasive can be molded and shaped into a wide variety of useful grinding shapes before completely curing the binder, such as including a grinding wheel shape or a conical shape. Other forms of bonded abrasives include cut off wheels, depressed wheels, and cup wheels.

In general, nonwoven abrasives include open, lofty, three-dimensional webs of organic fibers bonded together at points where they contact an abrasive binder. These webs may be roll-coated, spray coated, or coated by other means with binder precursor compositions including the nonabrasive composite grains of this invention and subsequently subjected to conditions sufficient to cure the resin.

In the following examples, objects and advantages of this invention are further illustrated by various embodiments thereof but the details of those examples should not be construed to unduly limit this invention. All parts and percentages therein are by weight unless otherwise indicated.

EXAMPLES

In the examples, four different Abrasive Efficiency Test Procedures, I to IV, were used to evaluate coated abrasion products (belts or discs) described in those examples. The abrasive testing procedures and methods for making the belts and discs will first be described.

Abrasive Efficiency Test Procedure I

The coated abrasive product to be evaluated was converted into two 7.6 cm×335 cm endless abrasive belts which were tested on a constant-load surface grinder. A preweighed, 304 stainless steel workpiece, approximately 2.5 cm×5 cm×18 cm, was mounted in a holder, positioned vertically, with the 2.5 cm×18 cm face confronting an approximately 36 cm diameter, 60 Shore A durometer serrated rubber, contact wheel and one-on-one lands over which entrained the coated abrasive belt. The workpiece was then reciprocated vertically through an 18 cm path at the rate of 20 cycles per minute, while a spring-loaded plunger urged the workpiece against the belt with a load of 11.0 kg as the belt was driven at about 2,050 m/minute. After 30 seconds of grinding time had elapsed, the workpiece holder assembly was removed and reweighed, and the amount of stock abrasively removed from the workpiece was calculated by subtracting the weight thereof after abrading from the original weight. Then a new, pre-weighed workpiece and holder were mounted on the equipment. The experimental error on this test was about +/−10%. The total cut is a measure of the total amount of stainless steel removed during the test. The test was deemed ended when the amount of final cut of stock was less than one-third the amount of initial cut for two consecutive 30 second intervals.

For purposes of Test Procedures I, II, III and IV described herein, in general, the initial cut is the amount of the workpiece removed upon completion of the first prescribed interval of grinding; the final cut is the amount of workpiece removed in the last interval of grinding; and the total cut is the total amount of workpiece removed over the entire grinding procedure for the subject workpiece.

Abrasive Efficiency Test Procedure II

Fibre discs were made of the coated abrasive product, each disc having a diameter of 17.8 cm, with a 2.2 cm diameter center hole and backing thickness of 0.76 mm, were installed on a slide action testing machine. The fibre discs were first conventionally flexed to controllably break the hard bonding resins, then mounted on a beveled aluminum back-up pad, and used to grind the face of an 1.25 cm×19.8 cm 304 stainless steel workpiece. The disc was driven at 5,500 rpm while the portion of the disc overlaying the beveled edge of the back-up pad contacted the workpiece at 6.0 kg pressure, generating a disc wear path of about 140 $cm^2$. Each disc was used to grind a separate preweighed workpiece for 1 minute each, where the workpiece was reweighed after each such minute interval of grinding and the difference in weight noted, for a total time of 10 minutes each.

Abrasive Efficiency Test Procedure III

Fibre discs of coated abrasive products, each disc having a diameter of 17.8 cm, with a 2.2 cm diameter center hole and a backing thickness of 0.76 mm, were installed on a swing arm testing machine. The fibre discs were first conventionally flexed to controllably break the hard bonding resins, mounted on a beveled aluminum back-up pad, and used to grind the edge of a 304 stainless steel disc workpiece. Each disc was driven at 1710 rpm while the portion of the disc overlaying the beveled edge of the back-up pad contacted with the workpiece at 4.0 kg pressure, unless indicated otherwise in the following examples. Each disc was used to grind the same workpiece for a total of 10 minutes, unless indicated otherwise in the following examples, and the workpiece was preweighed and then weighed after every 1 minute of grinding.

Abrasive Efficiency Test Procedure IV

Endless abrasive belts (7.6 cm×335 cm) of a coated abrasive product were tested on a constant-load surface grinder by abrading a 1.9 cm diameter face of a 304 stainless steel rod with 12 successive 5-second grinding passes, weighing and cooling the rod after each pass, employing 68 lb. pressure and 2250 rn/min belt speed. The experimental error on this test was +/−10%.

General Procedure for Making Coated Abrasives Belts

In the following examples, the coated abrasive products were made using this procedure. The backing of each coated abrasive product was a Y-weight, woven, polyester cloth which had a four-over-one weave. Each backing was saturated with a latex/phenolic resin (namely, a resole phenolic resin with 75 wt. % non-volatile solids) and then placed in an oven to partially cure this resin. Next, a coating of that resin, filled with calcium carbonate, was applied to the back side of each backing. Each coated backing was heated to about 120° C. and maintained at this temperature until the resin had cured to a tack-free state. A pretreatment coating of the latex/phenolic resin was applied to the front side of each coated backing and each coated backing was heated to about 120° C. and maintained at this temperature until the resin had precured to a tack-free state. Each backing made by this procedure was completely pretreated thus and was ready to receive a make coat.

A coatable mixture for producing a make coat for each coated backing was prepared by mixing 69 parts of a 70 wt. % non-volatile solids phenolic resin (48 parts phenolic resin), 52 parts non-agglomerated calcium carbonate filler (dry weight basis), and enough of a solution of 90 parts water/10 parts ethylene glycol monoethyl ether to form a make coat in each case which had 83 wt. % nonvolatile solids and a wet coating weight of about 240 $g/m^2$. The make coat was applied in each case by roll coating. The resulting constructions received a precure of 15 minutes at 65° C., followed by 75 minutes at 88° C.

Next, grade 50 (ANSI standard B74.18, average particles size of 545 micrometers) ceramic aluminum oxide abrasive particles were drop-coated onto the uncured make coats as a uniform blend with the nonabrasive composite grains, if any, or other comparative diluents as indicated in the following examples.

A size coat was applied over the abrasive particles/make coat construction with two-roll coater. The wet size coating weight in each case was about 285 $g/m^2$. The size coat comprised, by wt. %, 32% resole phenolic resin (75% solids); 50.2% cryolite particles; and 16.3% aqueous 2-methoxy propanol (as a mixture of 85% 2-methoxy propanol and 15% $H_2O$, commercially available from Worum Chemical Co., Saint Paul, Minn.). The resulting coated abrasive article received a thermal cure of 30 minutes at 88° C. followed by 12 hours at 100° C.

A supersize coat was applied over the size coat at an average wet weight of approximately 155 $g/m^2$. The supersize coating composition comprised, by wt. %, 29.2% of an aqueous mixture (60 wt. % nonvolatile solids) of diglycidyl ether of bisphenol A epoxy resin with an epoxy equiv. wt. of about 600 to 700, commercially available as from Shell Chemical, Louisville Ky., under the trade designation "CMD 35201"; 53.3% $KBF_4$; 14.1% water; 0.75% sodium dioctyl sulfo-succinate, as a dispersing agent, available from Rohm & Haas Co., Philadelphia, Pa., under the trade designation "Aerosol OT"; 0.35% 2-ethyl-4methyl imidazole, as a curing agent, available from Air Products, Allentown, Pa., under the trade designation "EMI-24"; and 2.3% red iron oxide powder pigment. The supersized construction was cured for 3 hours. at 100° C. After this thermal cure, the coated abrasive articles were singly flexed (i.e., passed over a roller at an angle of 90° to allow a controlled cracking of the make and size coats), then converted into 7.6 cm×335 cm coated abrasive belts.

General Procedure for Making Coated Abrasives Discs

A coated abrasive disc was prepared according to the following procedure. A 0.76 mm thick vulcanized fibre backing having a 2.2 cm diameter center hole was coated with the above-described calcium carbonate-filled resole phenolic resin to form a make coat. The wet coating weight was approximately 161 g/m$^2$. Grade 36 ceramic $Al_2O_3$, commercially available Company, Saint Paul, Minn., under the trade designation "Cubitron 321" was electrostatically coated onto the make coat together with any nonabrasive composite grains or other diluents indicated in the following examples. The resulting abrasive article was precured for 150 minutes at 93° C. A size coat was applied over the layer of the abrasive grains and the make coat at an average weight of approximately 564 g/m$^2$ to form a size coat. The size coat comprised, by wt. %, 32% resole phenolic resin (75% solids); 50.2% cryolite particles; and 16.3% aqueous 2-methoxy propanol (as a mixture of 85% 2-methoxy propanol and 15% $H_2O$, commercially available from Worum Chemical Co., Saint Paul, Minn.). The resulting product was cured for 11.5 hours at 93° C.

A supersize coat was applied over the size coat at an average wet weight of approximately 322g/m$^2$. The supersize coating composition comprised, by wt. %, 29.2% of an aqueous mixture (60 wt. % nonvolatile solids) of diglycidyl ether of bisphenol A epoxy resin with an epoxy equiv. wt. of about 600 to 700, commercially available from Shell Chemical, Louisville Ky., under the trade designation "CMD 35201"; 53.3% $KBF_4$; 14.1% water; 0.75% sodium dioctyl sulfo-succinate, as a dispersing agent, available from Rohm & Haas Co., Philadelphia, Pa., under the trade designation "Aerosol OT"; 0.35% 2-ethyl-4-methyl imidazole, as curing agent, available from Air Products, Allentown, Pa., under the trade designation "EMI-24"; and 2.3% red iron oxide powder pigment. The supersized construction was cured 3 hours at 100° C. After this step, the coated abrasive discs were flexed and humidified at 45% RH for 1 week prior to testing.

Preparation of Composite Grains

Three batches of the composite grains, CG-1, CG-2, and CG-3, used in the examples below were prepared as follows:

CG-1: About 10 g of water was added to 75 g of a 45 wt. % aqueous dispersion of zinc stearate (99.9% through 325 mesh), commercially available from Witco Co., New York, N.Y., under the trade designation "AQ-90". Then, 100 g of $KBF_4$ (98% pure micropulverized potassium tetrafluoroborate, in which 95% by wt. passes through a 325 mesh and 100% by wt. passes through a 200 mesh) was added to the "AQ-90" dispersion with good stirring. Additional $H_2O$ was introduced to facilitate mixing. About 11 g of $NH_4OH$ was then added to gel the mixture. The resulting wet solid mix was dried in a tray at about 80° C. overnight. The dried solid was allowed to cool to about room temperature, crushed, and graded to desirable grit sizes.

CG-2(rods): About 10 g of $H_2O$ was added to 75 g of the "AQ-90" dispersion. Then, 100 g of $KBF_4$ was added to the dispersion with good stirring. Additional $H_2O$ was introduced to facilitate mixing. About 11 g of $NH_4OH$ was then added to gel the mixture. The resulting wet solid mix was injected into small rod molds and dried at 80° C. overnight. The resulting dried rods were cooled to room temperature before being released from molds.

CG-3: Same as CG-1 except cryolite ($Na_3AlF_6$) was used in place of $KBF_4$.

The compositions of the so-prepared composite grains are summarized in Table 1. The amounts of the indicated material contained in each composition are given in parts by weight.

TABLE 1

| | Nonabrasive Composite | | |
|---|---|---|---|
| Constituent | CG-1 | CG-2 | CG-3 |
| INORGANIC PARTICULATE: | | | |
| $KBF_4$ | 100 | — | — |
| cryolite | — | 100 | — |
| $CaCO_3$ | — | — | 100 |
| BINDER: | | | |
| "AQ-90" dispersion | 75 | 75 | 75 |
| WATER | 10 | 10 | 10 |
| $NH_4OH$ | 11 | 11 | 11 |

The grain layer formed on the make coats of the following Examples 1–6 and Comparative Examples A–D had the formulation of abrasive grains and diluent particles (if any), and respective coating weights, as indicated in Table 2. In Comparative Examples A, C, and D, the coated abrasive products were similarly prepared to Examples 1–6 except brown fused alumina ($Al_2O_3$, abrasive grains designated "BAO" in Table 2), was used instead of nonabrasive composite grains of this invention. In Comparative Example B, no diluent particle was used. The nonabrasive composite grains CG-1 to CG-3 in Table 2 have the compositions defined in Table 1 defined above.

TABLE 2

| | Abrasive Grain | | Diluent Particle | |
|---|---|---|---|---|
| Example | Grade | Coating wt. (g/m$^2$) | Type | Coating wt. (g/m$^2$) |
| Ex. 1 | 36 | 423 | CG-1 | 209 |
| Ex. 2 | 36 | 423 | CG-2 | 213 |
| Ex. 3 | 36 | 423 | CG-3 | 213 |
| Ex. 4 | 36 | 423 | CG-3 | 213 |
| Ex. 5 | 50 | 301 | CG-3 | 152 |
| Ex. 6 | 50 | 301 | CG-3 | 152 |
| Comp. Ex. A | 36 | 423 | BAO | 423 |
| Comp. Ex. B | 36 | 846 | None | — |
| Comp. Ex. C | 50 | 301 | BAO | 301 |
| Comp. Ex. D | 50 | 301 | BAO | 301 |

Examples 1 to 3 and Comparative Example A

The coated abrasives for Examples 1–3 and Comparative Example A ("CEA") were made according to the above General Procedure for Making Coated Abrasives Discs. The coated abrasive products were made using blends of nonabrasive composite grains (Examples 1–3) or brown fused aluminum oxide (Comparative Example A) with grade 36 "Cubitron 321" $Al_2O_3$ abrasive grains in a 50:50 volume ratio. Table 2 summarizes the types and coating weights of the various grains. Test Procedure II was utilized to test the abrasive efficiencies of the coated abrasive products. The performance results are tabulated in Table 3.

TABLE 3

| Example | Initial Cut (% of CEA) | Final Cut (% of CEA) | Total Cut (% of CEA) |
|---|---|---|---|
| CEA | 100 | 100 | 100 |
| 1 | 153.1 | 130.9 | 175.2 |
| 2 | 143.6 | 115.4 | 152.3 |
| 3 | 146.4 | 125.8 | 153.4 |

As seen from the results, the coated abrasive discs of Examples 1–3 displayed significantly improved results in all of initial, final and total cut performance in comparison to the comparative coated abrasive disc of Comparative Example A, and this was achieved where the coating weight of the nonabrasive composite grains in Examples 1–3 was approximately one-half the weight amount of brown fused aluminum oxide abrasive grains used in Comparative Example A.

Examples 4 and Comparative Example B

The coated abrasive products of Example 4 and Comparative Example B ("CEB") were made according to the General Procedure for Making Coated Abrasives Discs. The coated abrasive products were made using blends of nonabrasive composite grains (Example 4) with grade 36"Cubitron 321" $Al_2O_3$ grains in a 50:50 volume ratio. Table 2 summarizes the types and coating amounts of the various grains used. Test Procedure III was utilized on samples of the coated abrasive articles of interest at two different test loads of 2690 g, and 4000 g load to test the abrasive efficiencies of the coated abrasive products of these examples. The performance results obtained at the test load of 2690 g (10 minute test) are tabulated in Table 4, and the performance results obtained at the test load of 4000 g (5 minute test) are tabulated in Table 5, respectively.

TABLE 4

| Example | Initial Cut (% of CEB) | Final Cut (% of CEB) | Total Cut (% of CEB) |
|---|---|---|---|
| CEB | 100 | 100 | 100 |
| 4 | 129.4 | 119.0 | 128.1 |

TABLE 5

| Example | Initial Cut (% of CEB) | Final Cut (% of CEB) | Total Cut (% of CEB) |
|---|---|---|---|
| CEB | 100 | 100 | 100 |
| 4 | 112.7 | 144.9 | 128.7 |

As seen from the results, the coated abrasive discs of Example 4 displayed significantly improved results in all of initial, final and total cut performance in comparison to the comparative coated abrasive disc of Comparative Example B even under varied testing conditions, and this was achieved where only 50% of grade 36"Cubitron 321" grains was used.

Examples 5 to 6 and Comparative Examples C and D

The coated abrasive products for Example 5 and Comparative Example C ("CEC") were made according to the General Procedure for Making Coated Abrasive Belts. On the other hand, the coated abrasive products for Example 6 and Comparative Example D ("CED") also were made according to the General Procedure for Making Coated Abrasives Belts except that the size coating was altered to the extent of replacing the 50.2 wt. % cryolite with 51.5 wt. % $CaCO_3$; otherwise, the same procedure was used. The coated abrasive products of these tests were made using blends of nonabrasive composite grains (Examples 5, 6) or other nonabrasive diluents, if any, (Comparative Examples C, D) with grade 36 "Cubitron 321" $Al_2O_3$ grains in a 50:50 volume ratio. Table 2 summarizes the types and coating amounts of the various grains used.

Test Procedure I was utilized to test the abrasive efficiencies of the coated abrasive products, and the performance results thereof are tabulated in Table 6. Also, Test Procedure IV was additionally utilized to test the abrasive efficiencies of samples from the same coated abrasive products, and the performance results thereof are tabulated in Table 7.

TABLE 6

| Example | Initial Cut (% of CEC) | Final Cut (% of CEC) | Total Cut (% of CEC) |
|---|---|---|---|
| CEC | 100 | 100 | 100 |
| 5 | 100.7 | 117.0 | 109.5 |
| 6 | 97.8 | 128.6 | 111.1 |
| CED | 97.8 | 149.2 | 119.8 |

TABLE 7

| Example | Initial Cut (% of CEC) | Final Cut (% of CEC) | Total Cut (% of CEC) |
|---|---|---|---|
| CEC | 100 | 100 | 100 |
| 5 | 103.8 | 105.9 | 104.6 |
| 6 | 108.5 | 114.1 | 112.6 |
| CED | 103.6 | 108.3 | 107.4 |

The results show that the abrading performance of Example 5 was superior to that of Comparative Example C ("CEC") using a much larger amount of abrasive grains alone. Example 6 gave results superior to Comparative Example D ("CED") as tested by Test Procedure IV, and equal or substantially comparable thereto as tested under Test Procedure I, even though the amount of brown fused aluminum oxide abrasive grains used in Comparative Example D was about twice as much as the amount of nonabrasive composite grains in Example 6.

Examples 7–8 and Comparative Example E

Coated abrasive articles were made to study the effect of using $CaCO_3$ or sodium metaphosphate ($NaPO_3$), also referred to as insoluble "phosphate glass", as a nonabrasive inorganic particle in the nonabrasive composite grains. Zinc stearate and calcium carbonate combinations, and zinc stearate and sodium metaphosphate combinations, as binder/nonabrasive inorganic particulate mixtures for nonabrasive composite grains were made by the following procedure. To 100 g of the water insoluble ingredient of either $CaCO_3$ or $NaPO_3$ (commercially available from Sigma Chemical Co., Saint Louis, Mo.), as applicable, was added 60 g of"AQ-90" zinc stearate dispersion and the resulting solution was mixed thoroughly. Water was added to the extent necessary to facilitate mixing. About 5 g of ammonium hydroxide was added to gel the mixture. The resulting solid mass was dried at about 90° C., crushed, and screened to grade 36.

The coated abrasive disc products of Examples 7–8 and Comparative Example E ("CEE") were made as follows. A 0.76 mm thick vulcanized fibre backing having a 2.2 cm diameter center hole was coated with calcium carbonate-filled resole phenolic resin (83 wt. % solids) to form a make coat, where the make coat precursor was prepared the same way as that prepared for the above General Procedure for Making Coated Abrasives Belts. The wet coating weight was approximately 161 g/m$^2$. The composite grains made from the above-described procedures were each mixed with grade 36 SiC and the blend thereof electrostatically applied into the phenolic make coat resin at the respective grain coating weights summarized in Table 8. The resulting abrasive article was precured for 150 minutes at 93° C. A size coat was applied over the layer of the abrasive grains and the make coat at an average weight of approximately 605 g/m$^2$ to form a size coat precursor. The size coat comprised, by wt. %, 32% resole phenolic resin (75% solids); 51.7% $CaCO_3$; and 16.3% aqueous 2-methoxy propanol (as a mixture of 85% 2-methoxy propanol and 15% $H_2O$, commercially available from Worum Chemical Co., Saint Paul, Minn.). The resulting product was cured for 11.5 hours at 93° C. After this step, the coated abrasive discs were flexed and humidified at 45% RH for one week. No supersize coat was applied.

TABLE 8

| | Coating Weights of Grains, g/m$^2$ | | |
|---|---|---|---|
| Example | Grade 36 SiC | $CaCO_3$ + Zn Stearate | $NaPO_3$ + Zn Stearate |
| 7 | 347 | 214 | — |
| 8 | 347 | — | 220 |
| CEE | 694 | — | — |

The sample discs obtained from these examples were tested for abrasive efficiency by Test Procedure III except that a titanium disc workpiece was used (not a stainless steel workpiece) and the results are summarized in Table 9.

TABLE 9

| Example | Initial Cut (g) | Final Cut (g) | Total Cut (g) |
|---|---|---|---|
| 7 | 2.13 | 0.81 | 10.9 |
| 8 | 2.31 | 1.06 | 13.3 |
| CEE | 2.06 | 0.68 | 9.9 |

The results displayed in Table 9 show that the coated abrasive discs containing $NaPO_3$ or $CaCO_3$ nonabrasive particles in nonabrasive composites partnered with the abrasive grains outperformed the Comparative Example E ("CEE") disc using SiC abrasive grains alone. Further the results for Example 8 using the $NaPO_3$ particulate were especially outstanding as compared to Comparative Example E ("CEE"), viz. the total cut of Example 8 was 134% of that of Comparative Example E ("CEE").

Various modifications and alterations of this invention will become apparent to those skilled in the art from the foregoing description without departing from the scope and spirit of this invention.

What is claimed is:

1. A method for making a coated abrasive article comprising the steps of:

(a) applying a make coat binder precursor to a backing;

(b) applying a plurality of abrasive grains and nonabrasive composite grains to said make coat binder precursor, wherein said nonabrasive composite grains comprise a plurality of inorganic nonabrasive particles bonded together by a binder selected from the group consisting of a metal salt of a fatty acid, colloidal silica, and combinations thereof, wherein the average particle size of said abrasive grains is a value x in micrometers, and the average particle size of the nonabrasive composite grains is a value y in micrometers, where the numerical value of the ritio y/x ranges from about 0.5 to about 2; and (c) curing said make coat binder precursor to adherently bond thereto said plurality of abrasive grains and nonabrasive composite grains.

2. The method of claim 1, further comprising the steps of:

(d) applying a size coat binder precursor over said make coat binder precursor and said plurality of abrasive grains and nonabrasive composite grains; and (e) curing said size coat binder precursor.

3. The method of claim 1, further comprising the steps of:

(d) applying a size coat binder precursor over said make coat binder precursor and said plurality of abrasive grains and nonabrasive composite grains;

(e) curing said size coat binder precursor;

(f) applying a supersize coat binder precursor over said size coat binder precursor; and (g) curing said supersize coat binder precursor.

4. The method of claim 1, wherein said plurality of abrasive grains and nonabrasive composite grains are applied sequentially or simultaneously to said make coat binder precursor in step (b).

5. A method of grinding titanium, comprising:

(a) providing a workpiece comprising titanium and a coated abrasive article comprising: a backing having a layer of grains adherently bonded thereto by a binding material, wherein said layer of grains comprises abrasive grains and nonabrasive composite grains wherein the average particle size of said abrasive grains is a value x in micrometers, and the average particle size of the nonabrasive composite grains is a value y in micrometers, where the numerical value of the ratio y/x ranges form about 0.5 to about 2, and said nonabrasive composite grains comprise sodium metaphosphate particles bonded together by a binder selected from the group consisting of a metal salt of a fatty acid, colloidal silica, and combinations thereof;

(b) frictionally engaging said coated abrasive article with a surface of said workpiece; and (c) moving said coated abrasive article relative to said workpiece surface effective to reduce said surface.

* * * * *